United States Patent [19]

Nittel

[11] Patent Number: 4,586,628

[45] Date of Patent: May 6, 1986

[54] RESILIENT INNER LINER FOR LINING OF TRANSPORT OR STORAGE CONTAINERS

[75] Inventor: Walter F. Nittel, Raunheim am Main, Fed. Rep. of Germany

[73] Assignee: JOSEF NITTEL GmbH & CO KG, Fed. Rep. of Germany

[21] Appl. No.: 548,007

[22] Filed: Nov. 2, 1983

[51] Int. Cl.[4] ..... B65D 85/00

[52] U.S. Cl. ..... 220/470; 220/403; 220/404

[58] Field of Search ..... 220/470, 402, 403, 404, 220/405, 400; 215/11 E

[56] References Cited

U.S. PATENT DOCUMENTS

| | | | |
|---|---|---|---|
| 1,484,606 | 2/1924 | Hanford | 220/404 |
| 2,364,943 | 12/1944 | Brandt | 220/403 |
| 2,991,906 | 7/1961 | Eligoulachvili | 220/403 |

FOREIGN PATENT DOCUMENTS 2900998 7/1980 Fed. Rep. of Germany .

*Primary Examiner*—Steven M. Pollard

*Attorney, Agent, or Firm*—James C. Wray

[57] ABSTRACT

An inner liner and method of inserting the same in a container is disclosed. The liner is folded in an umbrella shape to ensure even unfolding prior to filling of the container.

8 Claims, 8 Drawing Figures

RESILIENT INNER LINER FOR LINING OF TRANSPORT OR STORAGE CONTAINERS

The invention relates to a resilient inner liner for the lining of transport or storage containers, whereby the inner liner is provided with a tube-like removable, protective cover prior to insertion into the container, and a feed pipe to which a fitting can be secured.

Inner liners of this kind are disclosed in German patent No. 29 00 998. They provide an interchangeable, impervious lining for both pressureless or pressurized containers. The conventional inner liners are folded in such a manner that they are being expanded at the feed pipe and the opposite point thereto, causing them to form an elongated body. One end portion is folded over by 180° whereupon the inner liner is inserted into the protective cover, with the folded-over end first. The drawback of the inner liner being folded in such a manner is that the protective cover cannot be withdrawn prior to, or at the beginning of the filling procedure, as this would result in an uncontrolled unfolding of the inner liner and subsequently cause it to tear due to uneven tension and stress.

It is the objective of the invention to overcome this drawback and to ensure a uniform filling operation by employing a special folding technique.

This objective is achieved by folding the inner liner before it is inserted into the protective cover, in such a manner that the portion being opposite the feed pipe is retained on this part, and the inner liner is exteriorly folded in umbrella-like fashion towards an axis which runs in a direction of the feed pipe.

The umbrella-like folding technique causes the inner liner to fall outwardly and unfold evenly and radially when the protective cover is withdrawn, permitting smooth and undisturbed filling operation with equal stress throughout the inner liner.

According to a particularly advantageous embodiment of the invention, the inner liner consists of two synthetic films having circular cross sections, which are bonded together at the edges, one of which sections is provided with a central feed pipe. The two circular films can, at their edges, be bonded via a cylindrical member.

The liners disclosed serve to line containers of any shape which are to be filled with liquids to be retained therein with or without pressure. The pressure produced here may be cuased by inert gases like carbon dioxide or nitrogen. While any shape container may be used, containers of spherical or cylindrical shape are preferred. The inner liner of the invention is made of synthetic material, which is resilient and which is resistant to the material used in the filling process, and may consist of single or multi layers. A particularly suitable material is polyethylene. The feed pipe, which is also made of synthetic material, is bonded to the liner.

Further details and advantages of the invention are shown in the example depicted in the drawing, in which.

Figure 1:
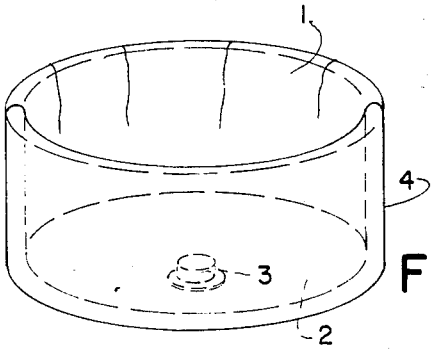
FIGS. 1–3 show various embodiments of the inner liner

The inner liner depicted in FIG. 1 consists of disk-like synthetic planar films 1, 2 which preferably are made of polyethylene and are bonded at their edges with a cylindrical center part 4. A reinforced cylindrical feed pipe 3 is bonded into lower film 2.

Figure 2:
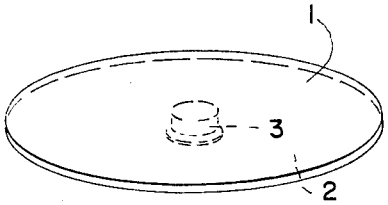

FIG. 2 shows a similar inner liner in which the two disk-like planar films 1, 2 are directly bonded at their edges, without center portion 4. This inner liner is particularly suitable for the lining of spherical containers.

Figure 3:
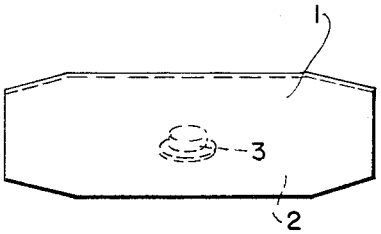
Figure 5:
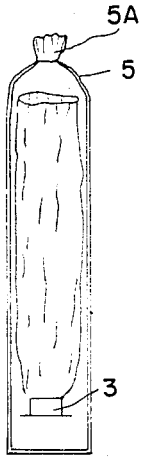
FIG. 5 shows the arrangement of the folded inner liner in a protective cover according to FIG. 4

FIG. 3 shows an additional inner liner, in which two octagonal films are bonded at their edges.

Figure 4:
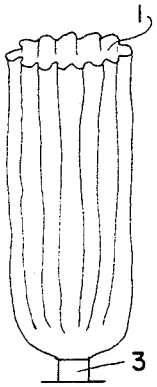
FIG. 4 shows the folded inner liner

To simplify matters, the folding technique of the invention is described by way of the inner liner depicted in FIG. 2. The folding here is such that the two disk-like planar film portions 1 and 2 are initially placed on top of each other. Subsequently, starting from the edge of feed pipe 3, the two films are evenly folded upwardly, whereby the center portion of upper film 1 remains on feed pipe 3. The result of ths folding technique is depicted in FIG. 4. Thereafter, the inner liner, thus folded, is placed into protective cover 5 which is closed at one end. This cover, for example, may consist of a synthetic tube of identical material, which at upper end 5A may, respectively, be bonded, tied, knotted, or remain open.

Figure 6:
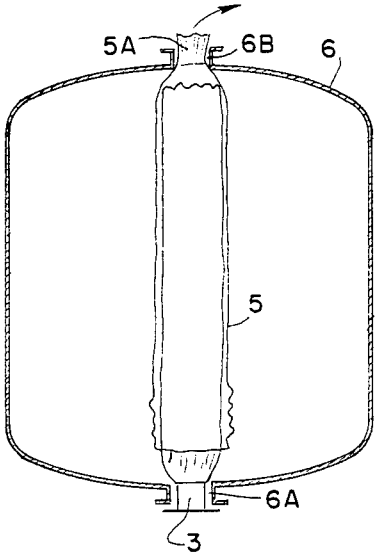
FIG. 6 shows the arrangement of the inner liner with protective cover in a tank
Figure 8:
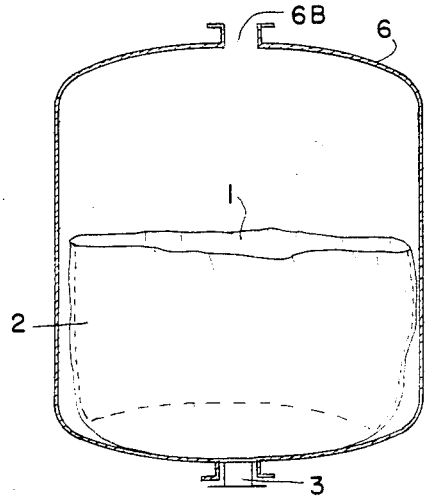
FIG. 8 shows unfolding of the inner liner.
Figure 7:
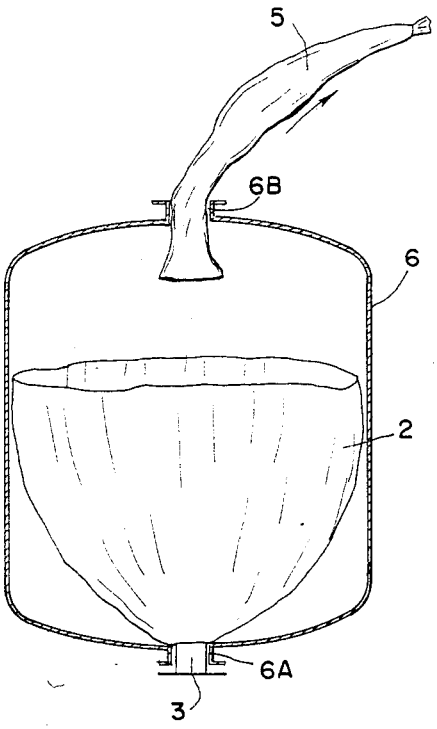
FIG. 7 shows withdrawal of the protective cover

As depicted in FIGS. 6–8, the inner liner thus equipped with protective cover 5, may now be inserted into container 6 and is ready for filling. Depicted contaner 6 has outlet 6A at the lower end and opening 6B at the upper end. Prior to filling, inner cover 1,2 with protective cover 5, is introduced into container 6 through lower opening 6A of container 6. To this end, a string, cord or wire is passed through container 6 via upper opening 6B and lower opening 6A, then is fastened at upper end 5A of the inner liner which, by this end portion, is subsequently pulled through container 6 until it is located in, or at the proximity of, upper opening 6B of container 6.

Feed pipe 3 is then secured to lower container opening 6A by way of a fitting. As depicted in FIG. 7, protective cover 5 can then be directly withdrawn, whereby the inner liner unfolds in the manner shown in FIG. 7. Once the filling operation begins, inner liner 1,2 adapts itself to the wall of container 6 and unfolds successively as the filling operation progresses.

I claim:

1. A liner apparatus comprising, a resilient liner having two planar films bonded to each other along peripheral edges, said two planar films producing the top and bottom walls of said liner, a feed pipe bonded to and extending through said bottom wall at a center portion thereof, the top and bottom walls being folded in an umbrella-like fashion, with the central portions of the top and bottom walls retained adjacent to the other, about an axis that runs in the direction of the feed pipe, the resulting folded liner being inserted into a removable tube-like protective cover.

2. The apparatus of claim 1 wherein the two planar films are circular in shape.

3. The apparatus of claim 1 wherein the two planar films are octagonal in shape.

4. The apparatus of claim 1 further comprising, a cylindrical film interposed between the two planar films, wherein one planar film is bonded to each opposite end of the cylindrical film.

5. A method of manufacturing a liner apparatus, comprising, bonding two planar films together along peripheral edges and thereby forming a resilient liner wherein said two planar films define the top and bottom walls of said liner, bonding a feed pipe to and extending it through said bottom wall at a center portion thereof, folding the top and bottom walls in an umbrella-like fashion, while retaining the center portions of the top and bottom walls adjacent the other, about an axis that runs in the direction of the feed pipe, and inserting the folded liner into a removable tube-like protective cover.

6. The method of claim 5 wherein the two planar films are circular in shape.

7. The method of claim 5 wherein the two planar films are octagonal in shape.

8. The method of claim 5 further comprising, interposing a cylindrical film between the two planar films, wherein one planar film is bonded to each opposite end of the cylindrical film.

* * * * *